US011306564B2

(12) United States Patent
Grove

(10) Patent No.: US 11,306,564 B2
(45) Date of Patent: Apr. 19, 2022

(54) DOWNHOLE TOOL FOR CREATING EVENLY-SPACED PERFORATION TUNNELS

(71) Applicant: HALLIBURTON ENERGY SERVICES, INC., Houston, TX (US)

(72) Inventor: Brenden Michael Grove, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 22 days.

(21) Appl. No.: 16/446,857

(22) Filed: Jun. 20, 2019

(65) Prior Publication Data

US 2020/0399993 A1 Dec. 24, 2020

(51) Int. Cl.
*E21B 43/116* (2006.01)
*E21B 43/119* (2006.01)

(52) U.S. Cl.
CPC ..... *E21B 43/116* (2013.01); *E21B 43/119* (2013.01)

(58) Field of Classification Search
CPC ... E21B 43/116; E21B 43/119; E21B 43/1193
See application file for complete search history.

(56) References Cited

U.S. PATENT DOCUMENTS 3,773,119 A * 11/1973 Shore ..... E21B 43/117 175/4.6
4,509,604 A * 4/1985 Upchurch ..... E21B 43/11852 175/4.52
4,552,234 A * 11/1985 Revett ..... E21B 43/117 175/4.6
4,726,431 A 2/1988 Oestreich
4,744,424 A * 5/1988 Lendermon ..... E21B 43/117 175/4.51
4,773,299 A * 9/1988 Oestreich ..... E21B 43/117 102/310
4,844,170 A * 7/1989 Gill ..... E21B 43/117 166/297
4,960,171 A * 10/1990 Parrott ..... E21B 43/117 166/297
5,054,564 A * 10/1991 Oestreich ..... E21B 43/117 175/4.6
5,392,857 A 2/1995 Behrmann
6,012,525 A * 1/2000 Burleson ..... E21B 43/116 166/297
6,014,933 A * 1/2000 Umphries ..... E21B 43/117 102/312
6,397,947 B1 6/2002 Behrmann et al.
2004/0118607 A1 6/2004 Brooks
2015/0376991 A1 12/2015 Mcnelis
2017/0275973 A1* 9/2017 Hardesty ..... E21B 43/116
2017/0275975 A1* 9/2017 Hardesty ..... E21B 43/117

OTHER PUBLICATIONS

Dictionary.com entry for "even", accessed Jun. 24, 2021 via www.dictionary.com.*
A. Venkitaraman, "Perforating Requirements for Sand Prevention", SPE-58788(Society of Petroleum Engineers), pp. 1-5, Feb. 23-24, 2000, Lafayette, Louisiana.

* cited by examiner

*Primary Examiner* — Blake Michener
(74) *Attorney, Agent, or Firm* — Chamberlain Hrdlicka

(57) ABSTRACT

A downhole tool for perforating a borehole includes a gun body and charges arranged in a helix around the gun body and evenly spaced from both a nearest neighbor along the helix and a nearest neighbor in an adjacent wrap of the helix. Further, placement of the charges is based on a specified diameter of the borehole and specified charge density.

18 Claims, 5 Drawing Sheets

DOWNHOLE TOOL FOR CREATING EVENLY-SPACED PERFORATION TUNNELS

BACKGROUND

Boreholes are drilled into a formation to extract production fluid, such as hydrocarbons, from the formation. To secure the borehole, casing is set within the borehole and cement is pumped into an annular area between a wall of the borehole and the casing. After the casing has been set, a downhole tool, such as a perforating gun, is conveyed into the borehole to perforate the casing. The downhole tool includes a number of charges longitudinally displaced from one another and typically in a spiraling pattern. After the downhole tool reaches a desired location within the borehole, the charges are detonated, thereby forming perforation tunnels through the casing and in the formation. The perforation tunnels form a flow path such that production fluid within the formation is able to flow out of the formation, through the perforation tunnels, and into the borehole, where the production fluid can be extracted.

The relative location of the charges and the pattern of the perforation tunnels formed by the charges affect the flow characteristics of the production fluid. For example, if the formation is loosely formed, the perforation tunnels may be prone to at least partially collapsing, which fills the perforation tunnel with debris, thereby blocking the flow of production fluid. In some instances, if the perforation tunnels are formed too closely, debris from one collapsed perforation tunnel can enter adjacent perforation tunnels and partially block production fluid flow in adjacent perforation tunnels. In some other instances, if the perforation tunnels are formed too closely, a wall between adjacent perforation tunnels may collapse to cause adjacent perforation tunnels to form a single, collapsed perforation tunnel that does not allow as high of a flow rate as two separate perforation tunnels. Further, increasing the rate of extraction of production fluids also increases pressure applied to the perforation tunnels, thereby increasing the likelihood of perforation tunnels collapsing. Also, if adjacent tunnels are too far apart, then at least some production fluid flows along a longer path to reach a perforation tunnel, which decreases the rate of extraction of production fluid.

BRIEF DESCRIPTION OF THE DRAWINGS

Embodiments of the downhole tool for creating evenly-spaced perforation tunnels are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides a downhole tool for creating evenly-spaced perforation tunnels.

Figure 1:
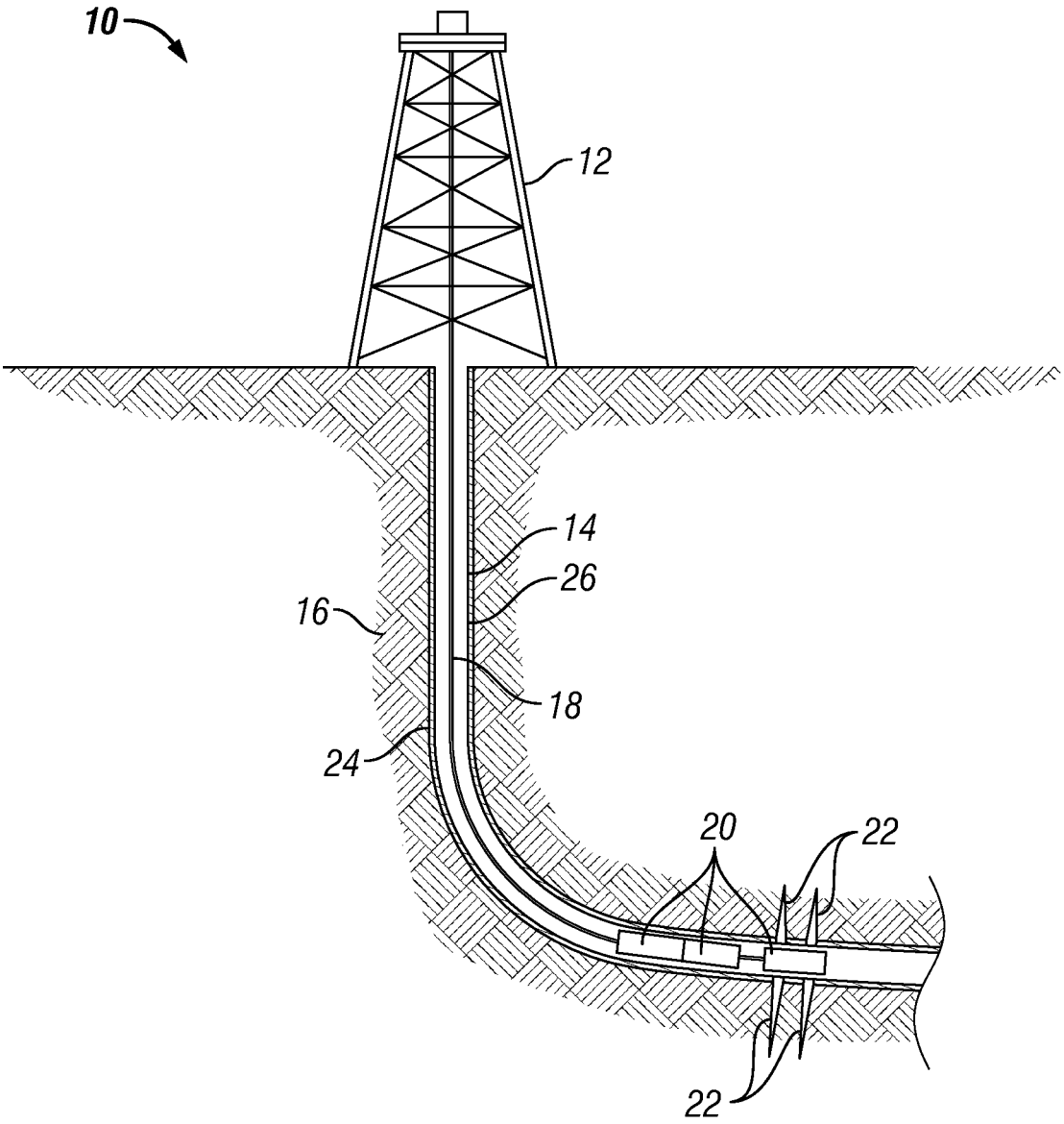
FIG. 1 illustrates a schematic view of well system with a downhole tool.

FIG. 1 illustrates a borehole system 10 that includes a rig 12 that is positioned over a borehole 14 that extends into a formation 16. The borehole 14 is an opening in the formation 16 and includes a tubular such as a casing or a liner. The borehole 14 is used to extract or store fluids, such as hydrocarbons or water. Further, while the borehole 14 is shown as extending vertically and horizontally into the formation 16, the borehole 14, or portions of the borehole 14, may extend at any angle between vertical and horizontal, including no angle.

The rig 12 is utilized to aid in operations with respect to the borehole 14. For example, the rig 12 includes a drilling rig, a completion rig, a workover rig, or a servicing rig. The rig 12 supports the wireline 18, which conveys one or more downhole tools 20 into the borehole 14. Instead of a wireline, slickline, tubing, or coiled tubing may be used to convey the downhole tools 20. The position of the downhole tools 20 in the borehole 14 may be monitored, such as by sensors positioned on the downhole tools 20 or by measuring a length of wireline 18 conveyed into the borehole 14. Further, the borehole system 10 may be positioned at an offshore location. For example, the rig 12 may be supported by piers extending into the seabed or by a floating structure.

The wireline 18 supports one or multiple downhole tools 20, which are used to form perforation tunnels 22. The downhole tools 20 include perforation tools with explosive charges. As such, the downhole tools 20 are used during a completion operation, after a casing 24 has been installed in the borehole 14. After the downhole tools 20 reach a target location, the explosive charges within the downhole tools 20 are detonated to penetrate the casing 24 and the formation 16 to form the perforation tunnels 22 which provide fluid communication between the borehole 14 and the formation 16. The spacing of the perforation tunnels 22 relative to one another affects the stability of the perforation tunnels 22 and flow characteristics of fluid flowing between the formation 16 and the borehole 14. As described in detail below, the downhole tools 20 are constructed to produce perforation tunnels 22 that are evenly-spaced in both a radial direction and a longitudinal direction, which reduces the risk of adjacent perforation tunnels 22 coalescing while also minimizing the maximum flow path of fluid flowing from the formation 16 into the borehole 14 (i.e., the longest distance fluid in the formation 16 flows before entering the borehole 14).

Figure 2A:
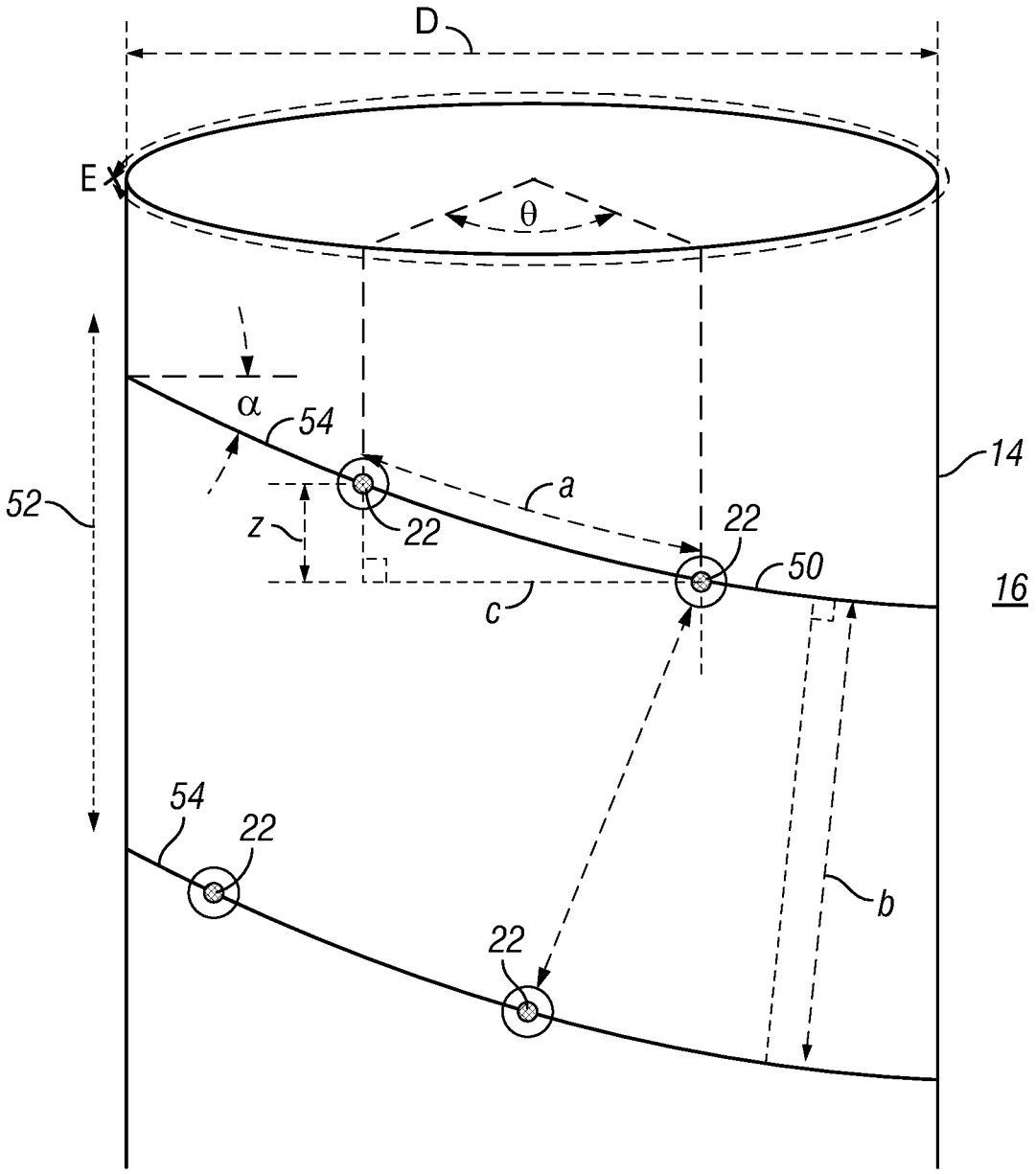
FIG. 2A illustrates a three-dimensional view of an evenly-spaced pattern of perforation tunnels formed in a formation.

FIG. 2A illustrates a three dimensional view of an evenly-spaced pattern of perforation tunnels 22 formed in the formation 16. The perforation tunnels 22 are located along a helix 50 which is a continuous line that wraps around the borehole 14 at a consistent pitch angle $\alpha$. Further, the perforation tunnels 22 are located such that a phase angle $\theta$ is the consistent angle between each perforation tunnel 22. For purposes of discussion, each portion of the helix 50 between a reference line 52 is referred to as a wrap 54, which is useful in distinguishing perforation tunnels 22 in a longitudinal direction. In the construction of the downhole tool 20, the pitch angle and the phase angle are determined such that a distance between adjacent perforation tunnels 22 along the helix 50 is the same as the distance between one of the perforation tunnels 22 and the nearest perforation tunnel 22 in an adjacent wrap 54. For reference, a length a is the distance between nearest-neighbor perforation tunnels 22, a length b is the distance between adjacent wraps 54, a length c is the azimuthal distance between adjacent perforation tunnels 22 along the same wrap 54, a length z is the longitudinal distance between adjacent perforation tunnels 22 along the same wrap 54, a length D is the diameter of the borehole 14, and a length E is the circumference of the borehole 14. Alternatively, the diameter D can refer to the diameter of the casing 24 in cases where even spacing is desired in the casing 24 rather than the borehole 14.

Figure 2B:
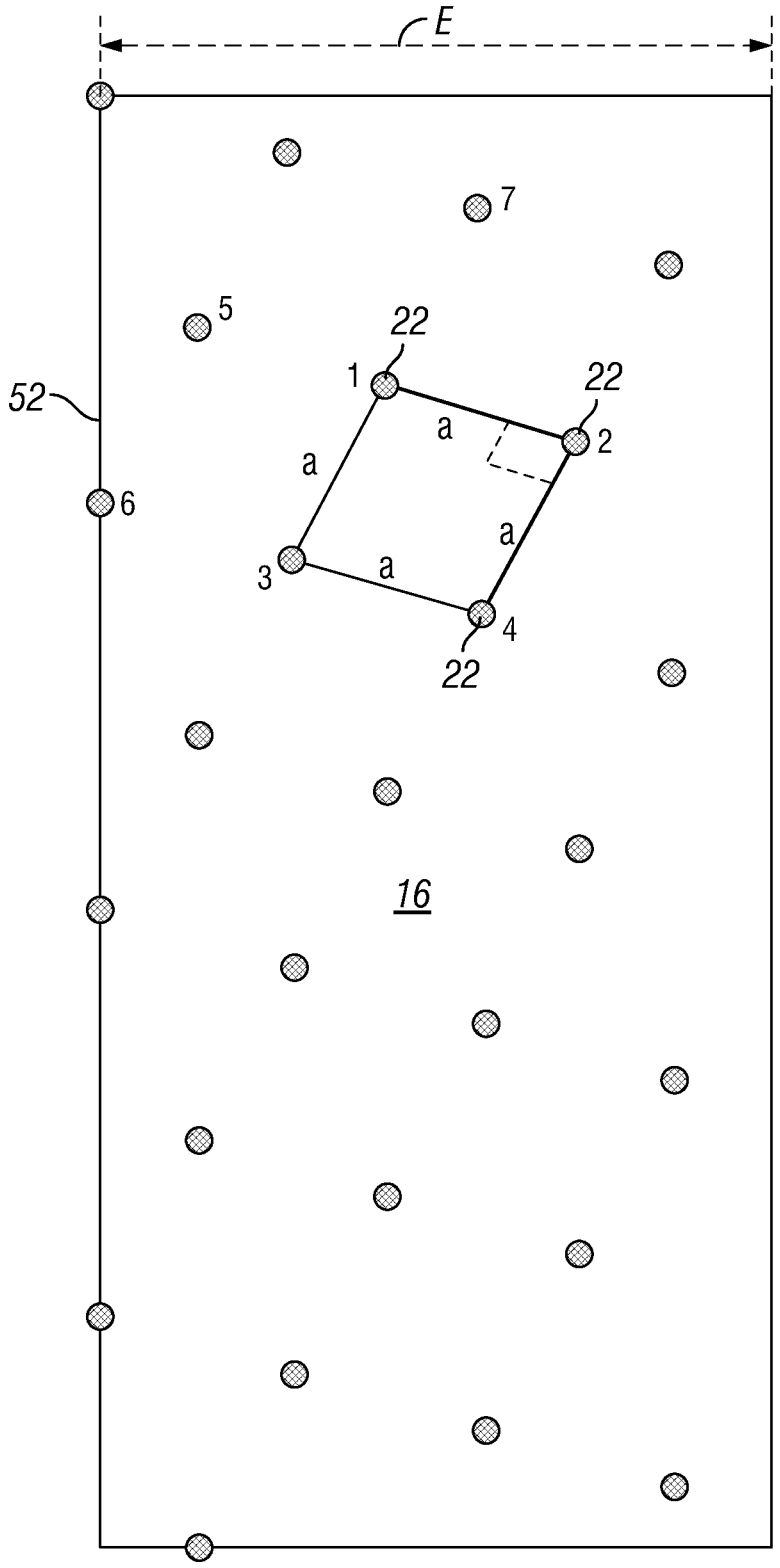
FIG. 2B illustrates a planar view of a square pattern of perforation tunnels in a formation.
Figure 2C:
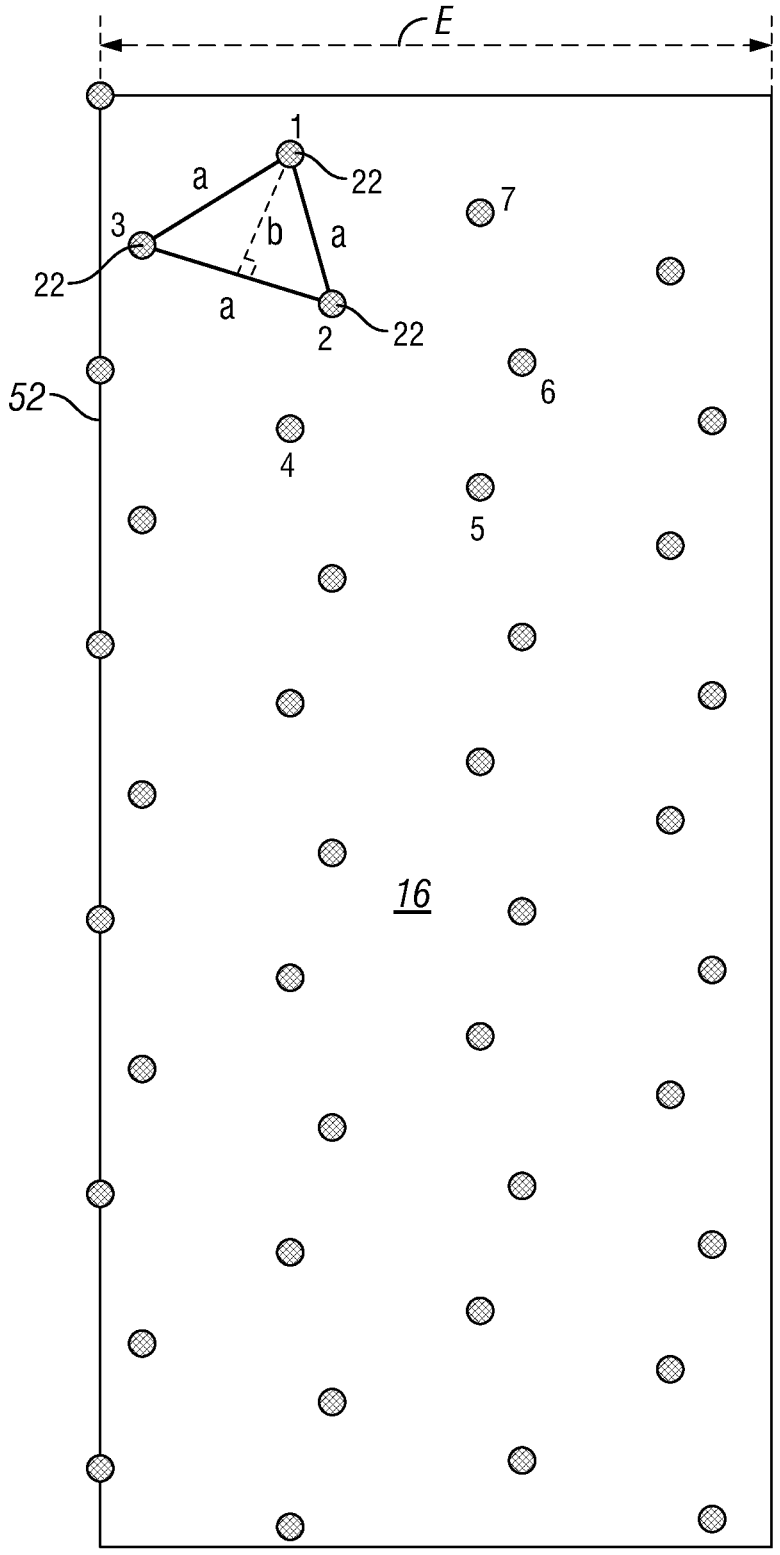
FIG. 2C illustrates a planar view of an equilateral triangle pattern of perforation tunnels in a formation.

To locate the perforation tunnels 22 both evenly along the helix 50 and between adjacent wraps 54, two patterns are considered. FIG. 2A illustrates the perforation tunnels 22 in a square pattern such that the length a is equal to the length b. In one or more other embodiments an equilateral triangular pattern is utilized. For example, FIGS. 2B and 2C illustrate planar views of the square pattern and the equilateral triangular pattern, respectively. In each of FIGS. 2B and 2C, a cylinder formed by the borehole 14, as shown in FIG. 2A, is split at the reference line 52 and flattened to a plane to more clearly illustrate the patterns of perforation tunnels 22.

In FIG. 2B, the perforation tunnels 22 are arranged in a square pattern. For example, perforation tunnels 1, 2, 3, and 4 are arranged in a square. To define the square pattern, an arbitrary perforation tunnel 22 is chosen, such as the perforation tunnel 1. Perforation tunnel 1 has four equidistant nearest neighbors, perforation tunnels 2, 3, 5, and 7. Two non-linear perforation tunnels are chosen, such as perforation tunnels 2 and 3. Then, the last point of the square is the one perforation tunnel that is equidistant from both perforation tunnels 2 and 3, which is perforation tunnel 4 in this case. This process can be repeated for any one of the perforation tunnels 22 in FIG. 2B, and thus, the pattern in FIG. 2B is defined as a square pattern.

In FIG. 2C, the perforation tunnels 22 are arranged in an equilateral triangle pattern. For example, perforation tunnels 1, 2, and 3 are arranged in an equilateral triangle. To define the equilateral triangle pattern, an arbitrary perforation tunnel 22 is chosen, such as the perforation tunnel 1. Perforation tunnel 1 has six equidistant nearest neighbors, perforation tunnels 2, 3, 4, 5, 6, and 7. Of the perforation tunnel 1-7, three are chosen that are all equidistant from each other. In the present example, perforation tunnels 1-3 were chosen to illustrate an equilateral triangle. However, it should be appreciated that, from the same group of perforation tunnels, equilateral triangles could be formed by perforation tunnels 1, 2, and 7, perforation tunnels 1, 7, and 6, perforation tunnels 1, 6, and 5, perforation tunnels 1, 5, and 4, or perforation tunnels 1, 4, and 3. This process can be repeated for any one of the perforation tunnels 22 in FIG. 2C, and thus, the pattern in FIG. 2C is defined as an equilateral triangle pattern.

If constraints differ between different perforation operations, the location of the perforations 22 will vary between operations. For example, the diameter D of the borehole and the charge density, or number of charges per longitudinal foot, may vary between operations. Prior to perforating, the diameter D of the borehole 14 will be known or specified as the borehole 14 is formed. Although it is not the subject of this application, the charge density is also determined or specified prior to a perforation operation, and the charge density may be based on composition of the formation, desired fluid flow rate between the borehole 14 and the formation 16, size of the charges, size of the borehole 14, or orientation of the borehole 14. Utilizing the below algorithm enables the locations of the perforations 22 to be determined based on an input of only the borehole diameter D and the charge density.

The algorithm first converts the diameter D to the circumference E by the following equation:

$$E=\pi*D \qquad \text{Equation 1:}$$

In addition, the charge density may be converted to the same units as the diameter D. For example, if the diameter D is expressed in inches and the charge density is expressed in charges per longitudinal foot, the charge density may be converted to charge per inch by the following equation:

$$z=\frac{12}{\text{charge density}} \qquad \text{Equation 2}$$

Note, that the length z is shown in FIG. 2A as the longitudinal distance between adjacent perforation tunnels 22 along the same wrap 54. After this setup, the algorithm relates the length b, which is the distance between adjacent wraps 54, and the length a, which is the distance between nearest-neighbor perforation tunnels 22, using the following equation:

$$b=n*a \qquad \text{Equation 3:}$$

In Equation 3, the variable n is dependent on whether a square pattern or an equilateral triangle pattern is utilized. For the square pattern, n is equal to 1, and in the equilateral triangle pattern, n is equal to one half times the square root of three. The algorithm may utilize the n value for the square pattern, the equilateral triangle pattern, or any intermediate value which yields the most even spacing if perfectly even spacing is not achievable. Further, Equation 3 is an intermediate equation that is used to relate a and b, and provides background for the variable n used in Equation 4 below. In addition, the pitch angle α is determined using the following equation:

$$\alpha=\sin^{-1}(\sqrt{n*z/E}) \qquad \text{Equation 4:}$$

After determining the pitch angle α, the length a, which is the distance between nearest-neighbor perforation tunnels 22, may be determined based on the right triangle formed by the length a, the length z, and the length c using the following equation:

$$a=z/\sin(\alpha) \qquad \text{Equation 5:}$$

Then, the length a can be inserted back into Equation 3 to determine the length b. Further, the length c may also be determined based on the right triangle formed by the length a, the length z, and the length c using the following equation:

$$c=a*\cos(\alpha) \qquad \text{Equation 6:}$$

After determining c, the phase angle θ, in degrees, between adjacent perforation tunnels 22 is determined using the following equation:

$$\theta=(c/E)*360 \qquad \text{Equation 7:}$$

Thus, using Equations 1-7, the algorithm outputs the phase angle θ, which, combined with the already-specified shot density, uniquely and fully defines the perforating charge configuration in the gun system. This in turn determines the location of all of the perforation tunnels 22, given one at a starting point. In addition, it is not necessary to know the total longitudinal length of the section of the borehole 14 having perforation tunnels 22 to determine either the phase angle θ or the pitch angle α. Thus, the algorithm can be applied to every size of perforation operation. Further, while the above algorithm is applied to a single helix, the above algorithm could also be applied to systems using multiple helixes.

As an example, a diameter D is specified to be 10 inches and charge density is specified as 12 charges per foot. After Equations 1 and 2, the circumference E is 10π inches and the charge longitudinal spacing is 1 inch per charge. In addition, this example will assume a square pattern such that the variable n is equal to 1. Thus, plugging the results of Equation 1 and 2 into Equation 4 results in a pitch angle $\alpha$ of about 10.3 degrees. Then, the pitch angle $\alpha$ is used in Equation 5, which results in a length a of about 5.6 inches. Further, because we assumed a square pattern, Equation 2 dictates that the length b is also equal to about 5.6 inches. Then, the length a and the pitch angle $\alpha$ are utilized in Equation 6 to determine that the length c is equal to about 5.5 inches. Next, the length c and the circumference E are plugged into the Equation 7, which results in a phase angle $\theta$ of about 63 degrees. In this example, the term about is used to round the resulting number to the nearest tenth of an inch (or nearest whole degree).

The above algorithm is used to determine the location of perforation tunnels 22 in the formation 16, but, because the output is in degrees, the algorithm can also be used to determine the placement of charges within a downhole tool 20 that includes a perforating tool, regardless of the size of the downhole tool 20. As such, the algorithm can be used in the manufacture of the downhole tool 20.

The above algorithm is performed by a computing device having a processing unit and a data storage device. For example, the processing unit may include any device for processing data, such as a microprocessor. The data storage device may include any device for storing data, such as non-persistent storage (e.g., volatile memory, such as random access memory, cache memory) or persistent storage (e.g., a hard disk, an optical drive such as a compact disk drive or digital versatile disk drive, or a flash memory).

Figure 3:
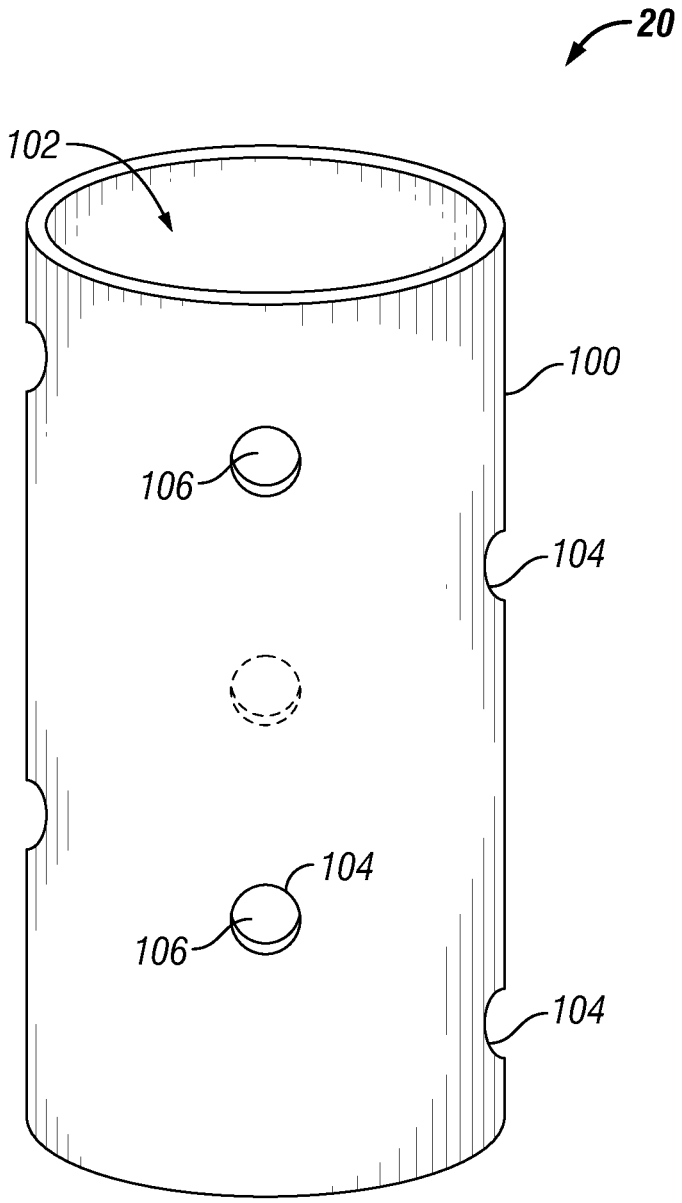
FIG. 3 illustrates a side view of a perforating gun having charges in an evenly-spaced pattern.

For example, FIG. 3 illustrates a downhole tool 20 manufactured using the above algorithm. The downhole tool 20 is a perforating tool that includes a gun body 100 that is tubular and includes a central cavity 102. Apertures 104 are formed radially through the gun body 100 to the central cavity 102. Then, charges 106 are placed within the central cavity 102 and aligned with the apertures 104 such that the stream of particles formed by detonation of the charges 106 travels through a respective aperture 104 and out of the gun body 100. Before manufacture of the downhole tool 20, the above algorithm is utilized to determine the locations of the apertures 104. The pitch angle $\alpha$ and the phase angle $\theta$ for the positions of the apertures 104 matches the pitch angle $\alpha$ and the phase angle $\theta$ for the positions of the perforation tunnels 22. The algorithm is thus used to determine the desired positions of perforation tunnels 22. Then, the downhole tool 20 is constructed with apertures 104 and charges 106 in positions matching the desired positions of the perforation tunnels 22. After constructing the downhole tool 20, the downhole tool 20 is conveyed into the borehole 14 to a desired location, and the charges 106 are detonated to form the perforation tunnels 22 in the desired positions.

In some perforating operations, capsule systems may be used in place of the gun body 100. For example, in capsule systems, each charge 106 includes a cover that protects the charge 106 from fluid while downhole. The cover replaces the gun body 100 and apertures 104. Thus, when using a capsule system, the above algorithm is utilized to determine the locations of the charges 106.

It should be appreciated that, in use, the resultant perforation tunnels 22 may not exactly match the desired positions of perforation tunnels 22. For example, manufacturing constraints of the downhole tool 20 may cause the apertures 104 to not be formed in the exact positions determined using the algorithm. The manufacturing constraints may include the precision of tools used to manufacture the downhole tools 20 or the dimensions of the charges 106 and their ability to physically fit within the central cavity 102 at the determined positions. Further, if multiple gun bodies 100 are stacked together, the process of stacking the gun bodies 100 may cause the positions of the apertures 104 to move from the desired positions. In addition, the operation of the downhole tools 20 may also be inexact and result in perforation tunnels 22 that are not in the exact determined positions. For example, detonation of the charges 106 may shift the position of the downhole tool 20.

Further examples may include:

Example 1 is a downhole tool for perforating a borehole includes a gun body and charges arranged in a helix around the gun body and evenly spaced from both a nearest neighbor along the helix and a nearest neighbor in an adjacent wrap of the helix. Further, placement of the charges is based on a specified diameter of the borehole and specified charge density.

In Example 2, the subject matter of Example 1 can further include wherein the charges are arranged in a square pattern.

In Example 3, the subject matter of Example 1 can further include wherein the charges are arranged in an equilateral triangle pattern.

In Example 4, the subject matter of Example 1 can further include wherein the charges are arranged in a geometric pattern intermediate between square and equilateral triangle patterns.

In Example 5, the subject matter of Examples 1-4 can further include a pitch angle of the helix is based on the diameter of the borehole and the charge density.

In Example 6, the subject matter of Examples 1-5 can further include a phase angle between each charge is based on the diameter of the borehole and the charge density.

In Example 7, the subject matter of Examples 1-6 can further include wherein the downhole tool is conveyable into the borehole on a slickline or a wireline, or tubing, or coiled tubing.

Example 8 is a method for manufacturing a downhole tool used to perforate a borehole. The method includes determining a position for each of multiple apertures formed radially along a helix around a gun body and the apertures are evenly spaced from both a nearest neighbor along the helix and a nearest neighbor in an adjacent wrap of the helix Further, the position is based on a specified diameter of the borehole and a specified charge density. The method also includes forming a gun body with the multiple apertures at the determined position. In addition, the method includes placing charges in a central cavity of the gun body and aligning the charges with each of the multiple apertures.

In Example 9, the subject matter of Example 8 can further include wherein the charges are arranged in a square pattern.

In Example 10, the subject matter of Example 8 can further include an arrangement of the charges form a pattern such that equilateral triangles are formable from charges in adjacent wraps.

In Example 11, the subject matter of Example 8 can further include wherein the charges are arranged in a geometric pattern intermediate between square and equilateral triangle patterns.

In Example 12, the subject matter of Examples 8-11 can further include determining a phase angle between each charge based on the diameter of the borehole and the charge density.

In Example 13, the subject matter of Examples 8-12 can further include determining the position of the apertures for both a square pattern of apertures and an equilateral triangle pattern of apertures.

In Example 14, the subject matter of Example 13 can further include wherein forming the gun body is based on a selection of the apertures being arranged in a square pattern, an equilateral triangle pattern, or any intermediate pattern between the square pattern and the equilateral triangle pattern.

In Example 15, the subject matter of Examples 8-14 can further include forming multiple gun bodies with the multiple apertures at the determined positions.

Example 16 is a method for perforating a borehole wall. The method includes conveying a downhole tool into a borehole formed in a formation to a target location. The downhole tool includes a gun body and charges arranged in a helix around the gun body and evenly spaced from both a nearest neighbor along the helix and a nearest neighbor in an adjacent wrap of the helix. Further, placement of the charges is based on a specified diameter of the borehole and specified charge density. In addition, the method includes detonating the charges to form perforation tunnels in the formation and distributed in the same circumferential positioning as the charges.

In Example 17, the subject matter of Example 16 can further include wherein the charges are arranged in a square pattern.

In Example 18, the subject matter of Example 16 can further include wherein the charges are arranged in an equilateral triangle pattern.

In Example 19, the subject matter of Example 16 can further include wherein the charges are arranged in a geometric pattern intermediate between square and equilateral triangle patterns.

In Example 20, the subject matter of Examples 16-19 can further include wherein a phase angle between each charge is based on the specified diameter of the borehole and the specified charge density.

One or more specific embodiments of the system and method for centralizing a tool in a borehole have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A downhole tool for perforating a borehole at a location in the borehole having a wall with a diameter, comprising:

a gun body; and charges arranged in a helix around the gun body and spaced to produce perforation tunnels in the wall at the location when detonated that are evenly spaced on the wall from both any nearest neighbor along the helix and a nearest neighbor in any adjacent wrap of the helix, and wherein placement of the charges is based on a specified charge density and a phase angle between each charge that is determined based on the diameter of the wall at the location.

2. The downhole tool of claim 1, wherein the charges are arranged to produce perforation tunnels in a square pattern in the wall when detonated.

3. The downhole tool of claim 1, wherein the charges are arranged to produce perforation tunnels in an equilateral triangle pattern in the wall when detonated.

4. The downhole tool of claim 1, wherein the charges are arranged to produce perforation tunnels in a geometric pattern in the wall where a first distance between a perforation tunnel on one helical wrap of the helix and the nearest adjacent wrap of the helix is the product of a second distance between nearest neighbors along the helix in the wall and a constant that is greater than or equal to one and less than or equal to one half times the square root of three.

5. The downhole tool of claim 1, wherein a pitch angle of the helix is based on the diameter of the wall at the location and the charge density.

6. The downhole tool of claim 1, wherein the downhole tool is conveyable into the borehole on a slickline or a wireline, or tubing, or coiled tubing.

7. A method for manufacturing a downhole tool used to perforate a borehole at a location in the borehole having a wall with a diameter, comprising:

determining a position for each of multiple apertures formed radially along a helix around a gun body and spaced to produce perforation tunnels in the wall at the location that are evenly spaced on the wall from both any nearest neighbor along the helix and a nearest neighbor in any adjacent wrap of the helix, wherein the positions are based on a specified charge density and a phase angle between each aperture that is determined based on the diameter of the wall at the location;

forming the gun body with the multiple apertures at the determined positions; and placing charges in a central cavity of the gun body and aligning the charges with the multiple apertures.

8. The method of claim 7, wherein the charges are arranged to produce perforation tunnels in a square pattern in the wall.

9. The method of claim 7, wherein the charges are arranged to produce perforation tunnels in an equilateral triangle pattern in the wall.

10. The method of claim 7, wherein the charges are arranged to produce perforation tunnels in a geometric pattern in the wall where a first distance between a perforation tunnel on one helical wrap of a helix and the nearest adjacent wrap of the helix is the product of a second distance between nearest neighbors along the helix in the wall and a constant that is greater than or equal to one and less than or equal to one half times the square root of three.

11. The method of claim 7, wherein forming the gun body is based on a selection of the apertures being arranged so as to produce perforation tunnels in the wall in a square pattern, an equilateral triangle pattern, or any pattern where a first distance between a perforation tunnel on one helical wrap of the helix and the nearest adjacent wrap of the helix is the product of a second distance between nearest neighbors along the helix in the wall and a constant that is greater than or equal to one and less than or equal to one half times the square root of three.

12. The method of claim 7, further comprising forming more than one of the gun bodies.

13. The method of claim 7, further comprising determining a pitch angle of the helix based on the diameter of the borehole wall at the location and the charge density.

14. A method for perforating a formation from within a borehole through the formation at a location having a wall with a diameter, comprising:

conveying a downhole tool into the borehole, wherein the downhole tool comprises:

a gun body; and charges arranged in a helix around the gun body and spaced to produce perforation tunnels in the wall at the location that are evenly spaced on the wall from both any nearest neighbor along the helix and a nearest neighbor in any adjacent wrap of the helix, the spacing of the charges being based on a specified charge density and a tease angle between each charge that is determined based on the diameter of the wall at the location; and detonating the charges to form evenly spaced perforation tunnels in the wall.

15. The method of claim 14, wherein the charges are arranged so as to produce the perforation tunnels in a square pattern.

16. The method of claim 14, wherein the charges are arranged so as to produce the perforation tunnels in an equilateral triangle pattern.

17. The method of claim 14, wherein the charges are arranged so as to produce the perforation tunnels in the borehole wall where a first distance between a perforation tunnel on one helical wrap of the helix and the nearest adjacent wrap of the helix is the product of a second distance between nearest neighbors along the helix in the wall and a constant that is greater than or equal to one and less than or equal to one half times the square root of three.

18. The method of claim 14, further comprising determining a pitch angle of the helix based on the diameter of the borehole wall at the location and the charge density.

* * * * *